US006293182B1

(12) United States Patent
Yokomachi et al.

(10) Patent No.: US 6,293,182 B1
(45) Date of Patent: Sep. 25, 2001

(54) PISTON-TYPE COMPRESSOR WITH PISTON GUIDE

(75) Inventors: Naoya Yokomachi; Takayuki Imai; Tatsuya Koide, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/292,784

(22) Filed: Apr. 13, 1999

(30) Foreign Application Priority Data

Apr. 16, 1998 (JP) ..... 10-106663

(51) Int. Cl.[7] ..... F04B 27/08
(52) U.S. Cl. ..... 92/71; 92/172
(58) Field of Search ..... 92/71, 172; 417/269

(56) References Cited

U.S. PATENT DOCUMENTS

| | | | | |
|---|---|---|---|---|
| 3,938,397 | * | 2/1976 | Rasmussen | 419/269 X |
| 3,939,717 | * | 2/1976 | Teisen | 417/269 X |
| 5,201,261 | | 4/1993 | Kayukawa et al. | 92/71 |
| 5,382,139 | | 1/1995 | Kawaguchi et al. | 417/269 |
| 5,461,967 | * | 10/1995 | Burkett et al. | 92/71 |
| 5,630,353 | * | 5/1997 | Mittlefehldt et al. | 92/71 |
| 5,738,000 | * | 4/1998 | Forster | 92/71 X |
| 5,899,135 | * | 5/1999 | Kanou et al. | 92/71 |
| 5,921,756 | * | 7/1999 | Matsuda et al. | 417/269 |
| 5,953,980 | * | 9/1999 | Ota et al. | 92/71 |
| 6,024,009 | * | 2/2000 | Morita | 92/12.2 |
| 6,095,761 | * | 8/2000 | Kanai et al. | 417/269 |
| 6,123,513 | * | 9/2000 | Hiramatsu et al. | 417/222.2 |

FOREIGN PATENT DOCUMENTS

| | | |
|---|---|---|
| 0 731 273 A | 9/1996 | (EP) . |
| 0 799 994 A | 10/1997 | (EP) . |
| 06 346844 A | 12/1994 | (JP) . |
| 7-180658 | 7/1995 | (JP) . |
| 7-189897 | 7/1995 | (JP) . |
| 7-189898 | 7/1995 | (JP) . |
| 8-61237 | 3/1996 | (JP) . |
| 10-131850 | 5/1998 | (JP) . |

OTHER PUBLICATIONS

EP 99 10 7243 Search Report dated Mar. 5, 2001.

* cited by examiner

*Primary Examiner*—John E. Ryznic
(74) *Attorney, Agent, or Firm*—Woodcock Washburn Kurtz Mackiewicz & Norris LLP

(57) ABSTRACT

A compressor comprises a piston having a piston head and an engaging portion, said piston head being inserted into a cylinder bore, said engaging portion having a piston guide and a shoe seat in which a shoe is incorporated, wherein said shoe is engaged with a swash plate. The piston reciprocates in correspondence to rotation of the swash plate and the piston head compressing a refrigerant by the reciprocal movement. The piston guide protrudes outward from the surface of the piston head, extending over said shoe seat, being formed with dimensions exceeding the corresponding shoe seat and being caused to reciprocate along the inner wall surface of said housing in line with reciprocation of said piston.

25 Claims, 5 Drawing Sheets

PISTON-TYPE COMPRESSOR WITH PISTON GUIDE

BACKGROUND OF THE INVENTION

1. Field of the Invention

The present invention relates to a compressor for compressing refrigerants by driving a piston with a swash plate, and in particular, compressors utilized in air conditioning systems.

2. Description of the Related Art

A known piston-type compressor that is operated by a swash plate is described in Japanese Laid-Open Patent Publication Nos. 7-189897. Such a compressor includes a piston having an integrated piston head and engaging portion. The piston head is disposed in a cylinder bore formed in the housing of the compressor so that the piston head can reciprocate therein and the engaging portion engages with a pair of shoes attached to a pair of shoe seats. The pair of shoes includes front and rear shoes and a swash plate is disposed between the pair of shoes. The swash plate is supported by a rotatably supported drive shaft and rotates together with the drive shaft by means of a rotor mounted on the drive shaft. The angle of inclination of the swash plate changes with respect to a plane perpendicular to the axis of rotation of the swash plate in accordance with the cooling demand when the compressor is in operation. When the swash plate rotates, the piston head reciprocates in the cylinder bore via the interaction between the swash plate and the engaging portion of the piston, thereby compressing a refrigerant disposed within the cylinder bore. In this way, the rotational movement of the drive shaft is converted into a linear movement that drives the piston.

A piston rotation force is generated by the piston being drawn toward rotating direction of the swash plate due to friction resulting from a compression reaction force of the piston between the swash plate and shoe and friction between the shoe and piston. As the compression reaction force increases, the rotation force on the piston also increases. Therefore, a turn stop portion is provided on the engaging portion in the known compressor and contacts the inner wall surface of the housing in order to prevent the piston from rotating around its center axis.

As a result, the turn stop portion will forcefully contact the inner surface wall of the housing during operation of the compressor, thereby causing the turn stop portion and the housing to wear out prematurely. In particular, if a refrigerant is utilized that must be compressed under high pressure to provide adequate cooling, such as is necessary with carbon dioxide, the discharge pressure of the compressor is increased in comparison to when a low pressure refrigerant, such as a fluorocarbon, is used. Thus, wear on these contacting parts may be significantly increased if a known compressor design is used with a high compression refrigerant.

The piston also generates a compression reaction force, which applies a force to the sides of the piston head. This side force increases linearly with increases in the compression reaction force and results in friction between the cylinder head and the inner surface of the cylinder bore. If a high compression refrigerant is used in the known compressor, the discharge capacity of the compressor may be decreased because carbon dioxide has a higher compressibility and a higher density, for example, than fluorocarbon. In other words, the diameter of the piston head can be decreased if a high compression refrigerant, such as carbon dioxide, is used instead of a low compression refrigerant.

However, if a high compression refrigerant is in fact used, the side force acting on the piston head will increase, because the compression reaction force of the piston also increases in comparison with the case in which a fluorocarbon is used. Therefore, if the piston diameter is decreased when a high compression refrigerant is used, premature wear on the piston head or the cylinder bore will be further increased by the combination of an increase in the side force and a decrease in the piston head area that receives the refrigerant pressure.

SUMMARY OF THE INVENTION

It is therefore an object of the invention to teach improved compressors that are capable of reducing piston and cylinder bore wear and therefore, improve the durability of the compressors. These compressors are particularly useful if a high compression refrigerant, such as carbon dioxide, is utilized in the compressor.

Preferably, a compressor is taught having a structure attached to the piston that prevents the piston head from rotating. This structure also preferably has a surface area that is larger than the portion of the piston that contacts the compressor cylinder bore during operation. Therefore, this additional structure can reduce facial pressure per unit area on the piston head and reduce or prevent the compressor from wearing out prematurely. This structure is particularly useful with high compression refrigerants, such as carbon dioxide, and can serve to both improve the durability of the compressor and reduce the size of the compressor.

Other objects, features and advantages of the present invention will be readily understood after reading the following detailed description together with the accompanying drawings and the claims.

DETAILED DESCRIPTION OF THE INVENTION

Figure 1:
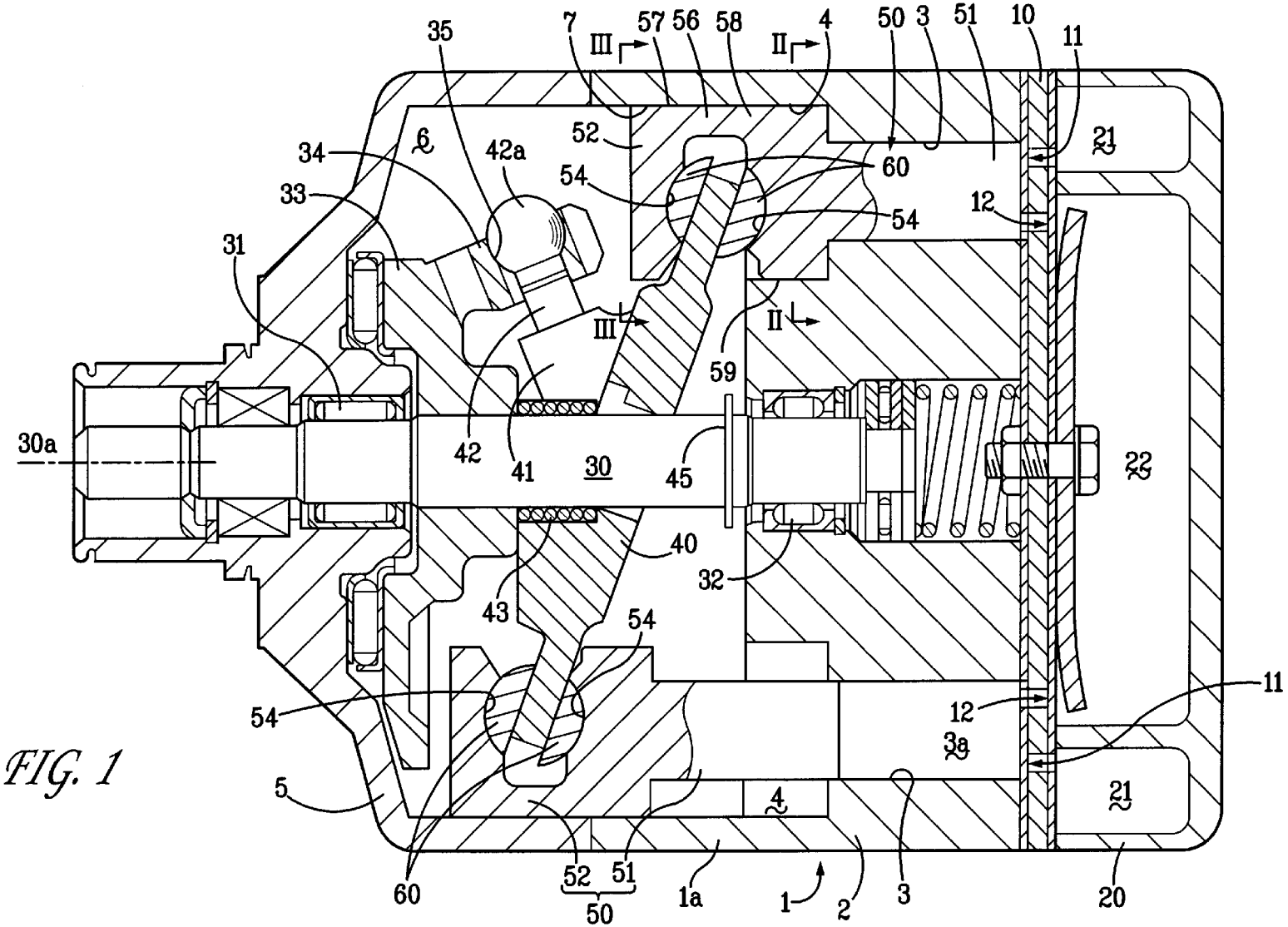
FIG. 1 shows a compressor according to a first representative embodiment.
Figure 2:
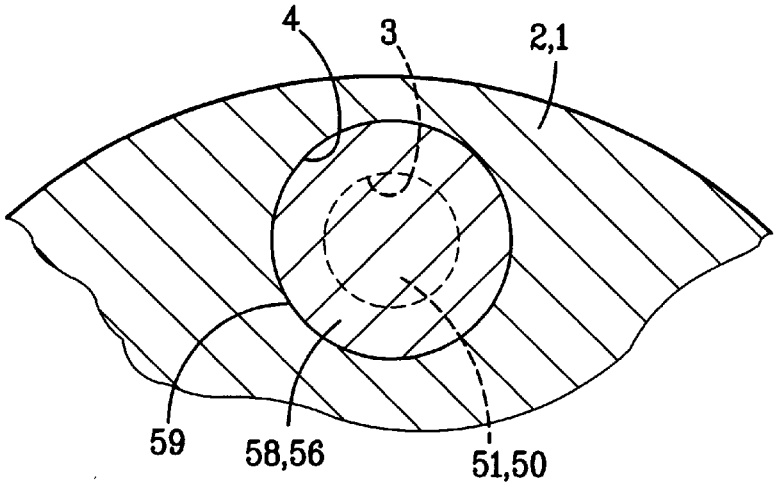
FIG. 2 is a sectional view taken along the line II—II in FIG. 1.
Figure 3:
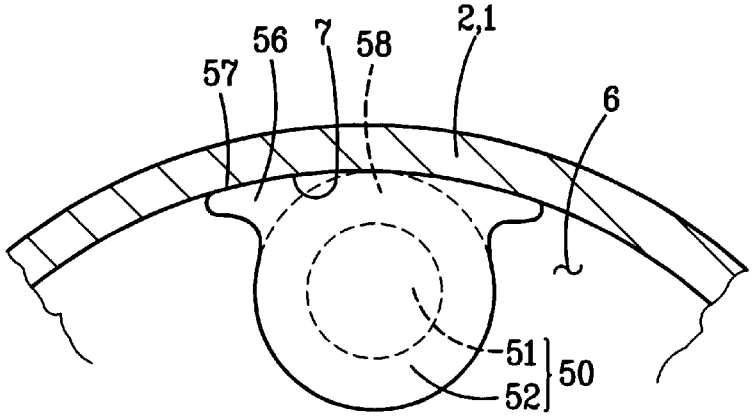
FIG. 3 is a sectional view taken along the line III—III in FIG. 1.

In one representative design, a compressor having at least one piston with a piston head and an engaging portion is taught. Preferably, the piston head is fitted onto and inserted into a cylinder bore formed in the housing of the compressor. The engaging portion preferably has a piston guide and a pair of shoe seats. A pair of shoes may be disposed on the pair of shoe seats for contacting a swash plate that rotates around an axis that parallel to the long axis of the drive shaft. The swash plate is preferably constructed so that the angle of the swash plate changes according to the cooling demand. The rotation of the swash plate is transmitted to the engaging portion of the piston head and the piston reciprocates. As a result of this reciprocating action, the piston head compresses a refrigerant disposed within the cylinder bore.

A piston guide is preferably disposed on the outer surface of engaging portion. The piston guide extends over the shoe seat and is preferably larger than the shoe seat. The piston guide will reciprocate against the inner wall surface together with the reciprocating piston head.

If any rotational forces are exerted on the piston via the shoes, as a result of the rotation of the swash plate, the piston guide contacts the inner wall surface of the housing, thereby preventing the piston from rotating. In this case, because the piston guide has a larger surface area than the shoe seat, the area that receives any rotational moment transmitted by the swash plate is increased. In other words, the facial pressure per unit area, which pressure is exerted onto the piston guide, is decreased, because the facial pressure is spread out over a larger area than in known compressor designs.

Because the piston guide effectively prevents the piston from rotating and the piston guide contributes to dispersion of the side force acting on the piston, wear to the inner wall surface of the housing and the piston guide can be effectively reduced, even if the rotational moment of the swash plate acting on the piston is relatively large.

The compressor also may be constructed so that the piston guide reciprocates along the inner wall surface of the housing via a curved guide surface. In this case, the curved portion is preferably annular or arcuate. The guide surface may face the inner wall surface of the housing either without any clearance between the guide surface and the inner wall surface or with a minute clearance. Further, a center axis of the arc of the guide surface may be coincident with a rotating axis of the drive shaft.

In a second representative example, the compressor may again comprise at least one piston having a piston head and an engaging portion, in which the piston head is disposed within the cylinder bore formed in the housing of the compressor. The engaging portion may have a shoe seat in which a shoe is incorporated and the shoe can be engaged with a swash plate that rotates around a rotating axis of the drive shaft. Preferably, the swash plate rotates at an inclined angle to a plane perpendicular to the axis of rotation and the piston reciprocates in correspondence to the rotation of the swash plate via the shoe and shoe seat. As the piston reciprocates, the piston head in the cylinder bore compresses a refrigerant.

However, in the second representative embodiment, a guide bore preferably is formed adjacent to the cylinder bore and may have a greater diameter than the cylinder bore. Further, the engaging portion may comprise a fitting guide having a fitting surface that complements the guide bore, so that the fitting guide can reciprocate within the guide bore. In such a compressor, both the piston head and the fitting guide bear the side force generated as a result of the compression reaction force of the piston. Because the fitting guide has a greater diameter than the cylinder bore, the side force acting on the piston will be exerted on the fitting guide which has a greater pressure receiving area than that of the piston head. Therefore, it is possible to decrease the wear caused by the relatively great side force acting onto the piston head.

Furthermore, since the fitting guide has a greater diameter than that of the piston head, the contacting area with the guide bore is increased. Therefore, this feature contributes to preventing the piston from rotating, thereby effectively reducing wear in the contacting area between the inner wall surface of the housing and the outer surface of the piston head. The fitting surface may be, for example, cylindrical or arcuate. Also, the center axis of the fitting guide portion may be eccentric with respect to the axial center of the piston head. Further, the surface of the fitting guide may face the inner wall surface of the guide bore with a dimensional clearance (tolerance) between the fitting surface and the guide bore.

Preferably, the compressors according to the present teachings utilize a high compression refrigerant, such as carbon dioxide. More preferably, such compressors are utilized in an air conditioning system having a cooling circuit and/or heating circuit.

Each of the additional features and method steps disclosed above and below may be utilized separately or in conjunction with other features and method steps to provide improved compressor and methods for making such compressors. Representative examples of the present invention, which examples utilize many of these additional features and method steps in conjunction, will now be described in detail with reference to the drawings. This detailed description is merely intended to teach a person of skill in the art further details for practicing preferred aspects of the present teachings and is not intended to limit the scope of the invention.

First Detailed Representative Embodiment

A description is given with respect to the compressor of a first detailed representative embodiment with reference to FIG. 1 through FIG. 5. FIG. 1 is a longitudinal sectional view of a swash plate type compressor 1 of variable capacity, in which a high compression and high-density refrigerant, such as carbon dioxide, is used. Housing 1*a* of the compressor 1 may comprise a cylinder block 2, a front housing 5 connected to and fixed at the front end of the cylinder block 2 and a rear housing 20 connected to and fixed at the rear end of the cylinder block 2. A valve plate 10 may be disposed between the rear housing 20 and the cylinder block 2.

The drive shaft 30 preferably extends in the cylinder block 2 and the front housing 5 and may be rotatably supported by bearings 31 and 32. The drive shaft 30 can be connected to an engine (not illustrated) installed in a vehicle, or some other drive source to provide drive power to the drive shaft 30 via a electro-magnet clutch (not illustrated.) A rotation supporting body 33 and a swash plate 40 are provided on the drive shaft 30 in a crank chamber 6 of the front housing 5. Preferably, the rotation supporting body 33 is attached to the drive shaft 30, so that the rotation supporting body 33 and the drive shaft 30 rotate together. A supporting arm 34 having a guide hole 35 with respect to the swash plate 40 preferably protrudes from the circumferential edge of the rotation supporting body 33.

The inclination angle of swash plate 40 with respect to the drive shaft 30 can vary during the operation of the compressor in accordance with the cooling demand. When the swash plate 40 varies its inclination angle, it can slide in the axial direction along the drive shaft 30. A linkage piece 41 may be integrally secured or fixed to one end portion of the swash plate 40. A guide pin 42 having a spherical fitting portion 42*a* preferably protrudes from the tip end of the linkage piece 41. A fitting portion 42*a* of the guide pin 42 is fitted to and inserted into the guide hole 35 of the supporting arm 34. In this state, torque of the drive shaft 30 is transmitted to the swash plate 40 via the rotation supporting body 33.

The cylinder block 2 is preferably provided with a plurality of cylinder bores 3, wherein a piston 50 is disposed with each of the cylinder bores 3 so that the piston 50 can reciprocate therein. Accordingly, each cylinder bore 3 and the piston 50 define a compression chamber 3*a*.

At an opening of the respective cylinder bores 3 adjoining to the crank chamber 6, a guide bore 4 may be formed concentrically with the cylinder bore 3. This guide bore 4 may be adjacent to and communicate with the cylinder bore 3 and may have a greater diameter than the diameter of the cylinder bore 3.

As shown in FIG. 2 through FIG. 5, the piston is preferably integrally formed with a piston head 51 and an engaging portion 52. The piston head 51 may have a circular section disposed within the cylinder bore 3. Preferably, the engaging portion 52 protrudes from the base of the piston head 51 in a direction towards the crank chamber 6.

A swash plate attaching groove 53, into which the circumferential edge of the swash plate 40 is inserted, may be included in the engaging portion 52 and preferably has a concave shape. The front and rear shoe seats 54 preferably have concave spherical portions and the pair of shoes 60 engaged with the shoes seats 54 by spherical fittings in order to cooperate with the circumferential edge of the swash plate 40 disposed between the pair of shoe seats 54. Accordingly, the rotating movement of the swash plate 40 is converted into a linear reciprocation movement by the interaction with the pair of shoes 60 to drive the piston 50, thereby causing the piston head 51 to reciprocate within the cylinder bore 3. More specifically, the pair of shoes 60 are engaged with the swash plate 40. As the swash plate 40 rotates integrally with the drive shaft 30, as shown in FIG. 1, and the piston 50 reciprocates in the cylinder bore 3. By this reciprocating movement, the piston head 51 in the cylinder bore 3 compresses a refrigerant.

A piston guide 56 may be formed in the engaging portion 52 and preferably has a surface area that is greater than the pair of shoe seats 54. The piston guide 56 preferably protrudes toward the inner wall surface 7 of the crank chamber 6 and has a surface area that extends over the pair of shoe seats 54 and the piston head 51. The surface of the piston guide 56 may serve as a guide surface 57 to guide the piston 50 along the inner wall surface 7 of the crank chamber 6.

In the first detailed representative embodiment, the piston guide 56 preferably extends from one end of the engaging portion 52 to the other end of the engaging portion 52. A fitting guide 58 having a fitting surface 59 is preferably disposed adjacent to the piston head 51. This fitting guide preferably corresponds to the surface of guide bore 4. In particular, the fitting guide 58 of the piston guide 56 may be formed so that it has a greater diameter than the diameter of the piston head 51 and is concentric therewith. The fitting guide 58 also may have a circular cross section and have substantially the same diameter as the diameter of the guide bore 4. Furthermore, the guide surface 57 of the piston guide 56 may have an arcuate shape that is concentric with the axial center of the drive shaft 30. The guide surface 57 also may be substantially the same diameter as the diameter of the inner wall surface 7 of the crank chamber 6 and can face the inner wall surface 7 with a dimensional clearance.

As shown in FIG. 1, the rear housing 20 preferably is partitioned into a suction chamber 21 and a discharge chamber 22. The suction chamber 21 may communicate with the compression chamber 3*a* through a suction valve assembly 11 of the valve plate 10, and the discharge chamber 22 may communicate with the compression chamber 3*a* through a discharge valve assembly 12.

The stroke of the piston 50 may be changed according to the differential pressure between the pressure in the crank chamber 6 and the pressure in the compression chamber 3*a*. That is, the inclination angle of the swash plate 40 may be changed according to said differential pressure and the change of the inclination angle of the swash plate 40 defines the stroke of the piston 50 which determines the discharge capacity. A capacity volume control valve (not illustrated) may control the pressure in the crank chamber 6.

A stopper ring 45 may be mounted on the drive shaft 30 in order to define the minimum inclination angle position of the swash plate 40. Furthermore, a spring 43 is preferably attached to and wound around the drive shaft 30 between the swash plate 40 and the rotation supporting body 33 to bias the swash plate 40 toward the minimum inclination angle position.

In such a compressor 1, the swash plate 40 will rotate together with the drive shaft 30 via the rotation supporting body 33. Preferably, a vehicle engine is the drive source and drives the drive shaft 30, transmitting its drive power by means of an electromagnetic clutch. More preferably, such a compressor is utilized in a vehicle air conditioning and/or heating system.

When the rotating the swash plate 40 causes the piston 50 to reciprocate via the front and rear shoes 60, the refrigerant is drawn from the suction chamber 21 into the compression chamber 3*a* of the cylinder bore 3 via the suction valve assembly 11 of the valve plate 10. Preferably, carbon dioxide is utilized with this compressor and the carbon dioxide is compressed into a high-pressure state (approximately 100 times atmospheric pressure) in the compression chamber 3*a*. After compression, the refrigerant is discharged to the discharge chamber 22 via the discharge valve assembly 12 of the valve plate 10. The refrigerant is exhausted from the discharge chamber 22 into an external refrigerant circuit and is cooled in a condenser (not illustrated.)

Carbon dioxide has a relatively low critical temperature (31° C.) and an air conditioning system operated in a high temperature condition may exceed the critical temperature of carbon dioxide, such as during summer. Therefore the carbon dioxide in the condenser may reach a supercritical temperature. In that case, the cooled carbon dioxide refrigerant flows into an expansion valve (not illustrated) to maintain the high pressure of the refrigerant.

In the expansion valve, the pressure of the carbon dioxide is reduced (to approximately 35 times atmospheric pressure) and therefore, transitions to a gas/liquid mixed state. The carbon dioxide then flows into an evaporator, where it is evaporated, and then is fed back into the suction chamber 21.

As described above, the discharge pressure of the carbon dioxide refrigerant is approximately 100 times atmospheric pressure (fluorocarbons are approximately 15 times atmospheric pressure), the evaporation pressure is approximately 35 times atmospheric pressure (fluorocarbons are approximately 2 times atmospheric pressure). Therefore, the discharge capacity of the compressor may be decreased over known designs, because carbon dioxide can be utilized in a high pressure and high-density state. As a result, the diameter of the piston head 51 of the piston 50 also may be decreased over known designs.

In reciprocating movement of the piston 50, the side force acting upon the piston 50, which force is caused by a compression reaction force of the refrigerant, is borne by the mutual contacting area between (1) the guide bore 4 and the fitting guide 58 and (2) the inner surface of the cylinder bore 3 and the outer surface of the piston head 51. Therefore, if the facial pressure of the mutual contacting area between the inner surface of the cylinder bore 3 and the outer surface of the piston head 51 can be reduced, the wear on this mutual contacting area can be reduced and the durability can be improved.

Figure 4:
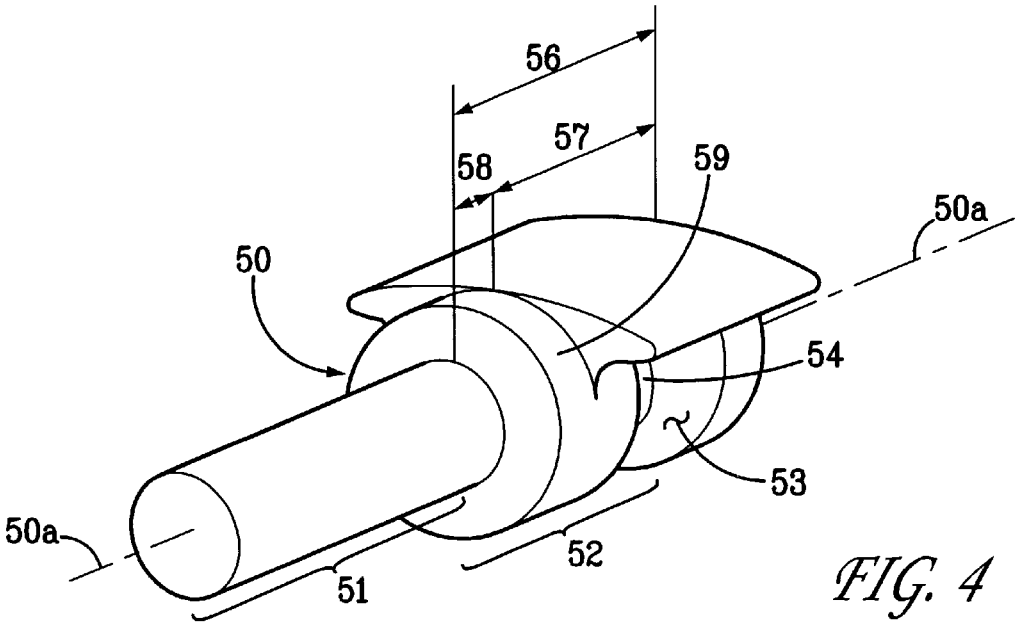
FIG. 4 shows a piston for a compressor.
Figure 5:
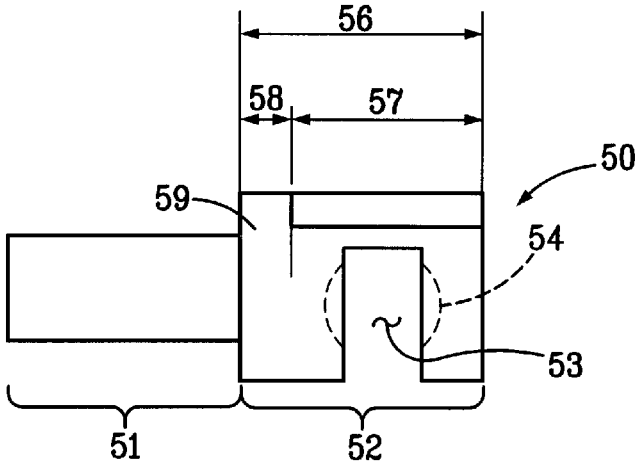
FIG. 5 shows also a piston for a compressor.

Furthermore, when the swash plate 40 rotates, a rotational moment is exerted onto the piston 50 in the direction that the piston 50 rotates around the axial line by the friction between the pair of shoes 60 and the pair of shoe seats 54. In such a case, because the guide surface 57 of the piston guide 56 contacts the inner wall surface 7 of the crank chamber 6, the piston 50 can be prevented from turning. In particular, as shown in FIG. 4 and FIG. 5, because the guide surface 57 of the piston guide 56 preferably extends over the pair of shoe seats 54 and contacts the inner wall surface 7 of the crank chamber 6, wear on the mutual contacting area between the inner wall surface 7 of the crank chamber 6 and the guide surface 57 of the piston guide 56 can be reduced or prevented, even if a large rotational moment is exerted onto the piston 50. Further, if the clearance between the guide surface 57 and the inner wall surface 7 of the crank chamber 6 is relatively small (or is eliminated), it is possible to bear the side force by the guide surface 57, in addition to the mutual contacting area between the inner surface of the cylinder bore 3 and the outer surface of the piston head 51.

Figure 6:
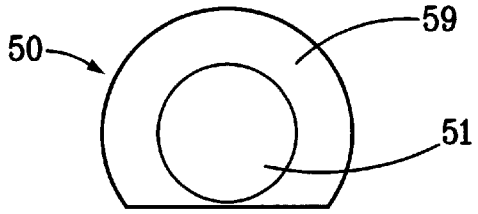
FIG. 6 shows a fitting guide for an engaging portion.

As described above, the fitting guide 58 may have a fitting surface 59 that is circular and corresponds to the inner surface of the guide bore 4. However, as shown in FIG. 6, the fitting surface 59 of the fitting guide 58 also may be arcuate. If a difference exists in the amount of side force that is applied to the piston 50 during the reciprocation of the piston 50, an arcuate portion of the fitting guide 58 may be provided on the inner wall surface of the guide bore 4 so as to correspond to one side of the piston 50 where the side force is the greatest. In this case, wear on the mutual contacting area between the inner surface of the cylinder bore 3 and the outer surface of the piston head 51 can be effectively reduced.

Second Detailed Representative Embodiment

Figure 7:
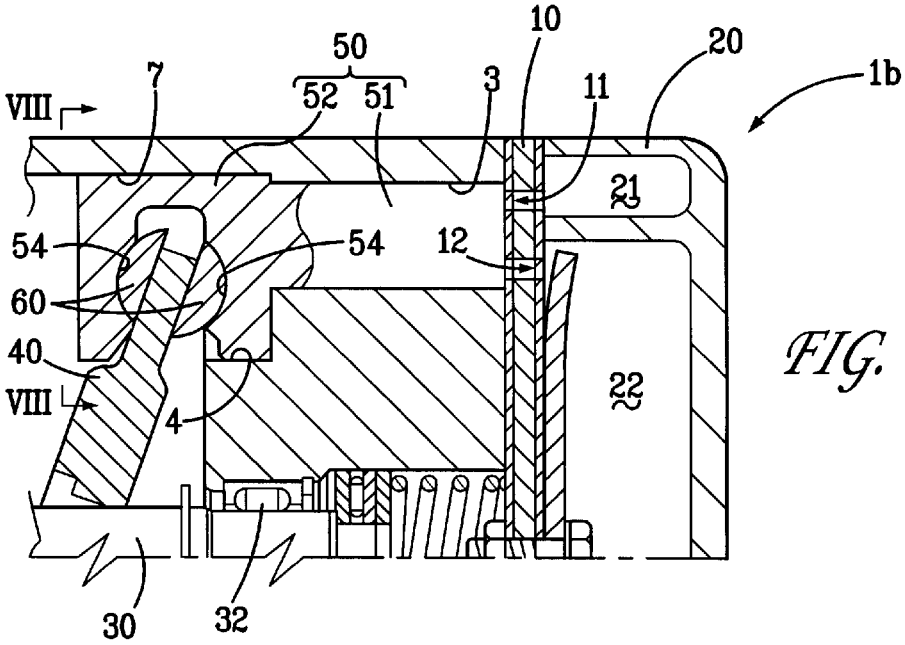
FIG. 7 shows a compressor according to a second representative embodiment.
Figure 8:
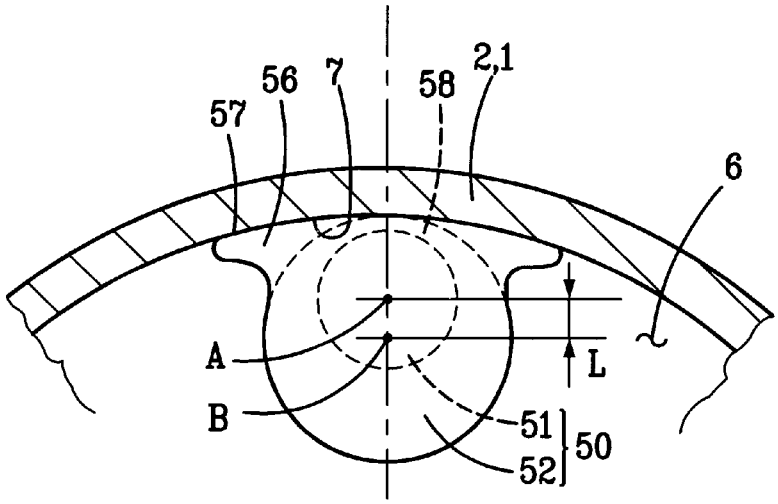
FIG. 8 is a sectional view taken along the line VIII—VIII in FIG. 7.
Figure 9:
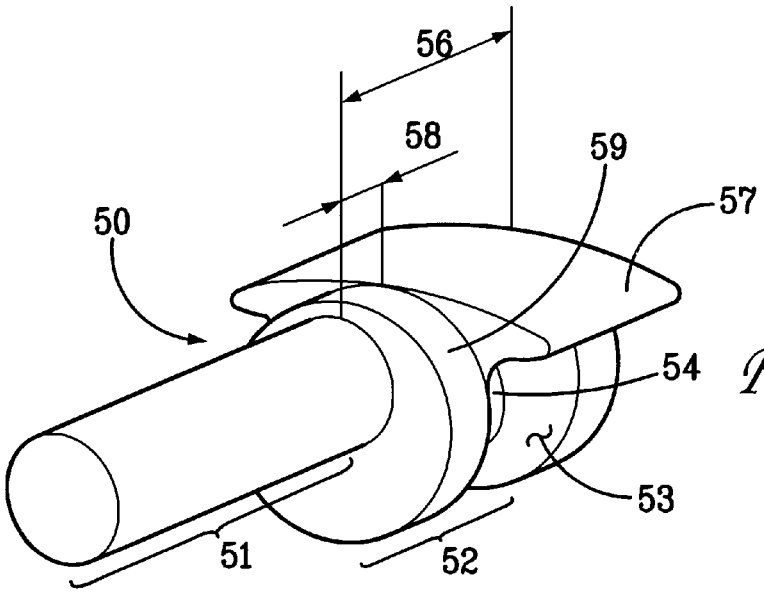
FIG. 9 shows a piston of the compressor according to the second representative embodiment.

A second detailed representative embodiment of a compressor will be described with reference to FIG. 7 through FIG. 9. As shown in FIG. 8, in compressor 1*b,* the fitting guide 58 of the piston guide 56 disposed on the engaging portion 52 of the piston 50 may have a circular cross section. The diameter of the fitting guide 58 is preferably larger than the diameter of the piston head 51. The axial center B of the fitting guide section 58 is offset from the axial center A of the piston head 51 toward the axial center of the drive shaft 30 by a distance L. The guide surface 57 of the piston guide 56 (excluding the fitting guide section 58) also may be arcuate so as to have the same axial center as the axial center of the drive shaft 30. The guide surface 57 may face the inner wall surface 7 of the crank chamber 6 with a dimensional clearance.

Because the construction of the first detailed representative embodiment generally corresponds to the construction of the second detailed representative embodiment, the same reference numbers are given to the same components, and description will be omitted for components that are common between the two embodiments.

Compressor 1*b* generally operates in a similar manner to achieve the same effects as the first detailed representative embodiment. In addition, the scale of the housing 1*a* can be reduced by an amount equivalent to the amount at which the axial center B of the fitting guide section 58 of the piston guide 56 is offset from the axial center of the piston head 51 toward the axial center of the drive shaft 30 (distance L). Further, the fitting section between the guide bore 4 and the fitting guide 58 also may function as a turn stop portion of the piston 50. Therefore, the fitting section can prevent the piston 50 from rotating over a wide area extending over the pair of shoe seats 54 by the guide surface 57 and fitting guide 58.

Figure 10:
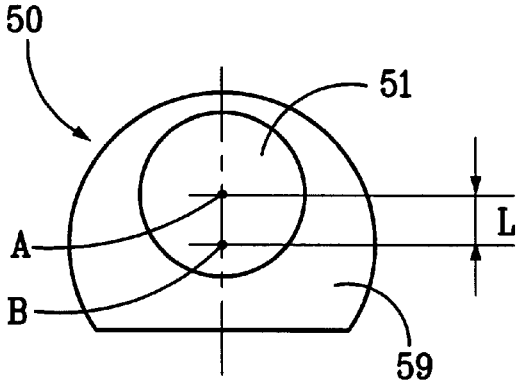
FIG. 10 shows a fitting guide according to the second representative embodiment.

As shown in FIG. 10, the fitting surface 59 of the fitting guide 58 which has an axial center B offset by a distance L from the axial center A of the piston head 51, may be arcuate in shape. The arcuate portion of the fitting guide 58 can be disposed on the side of the piston 50 where the side force is the greatest (compared to other portions) in order to prevent, or at least significantly reduce, wear in the mutual contacting area between the inner surface of the cylinder bore 3 and the outer surface of the piston head 51.

Third Detailed Representative Embodiment

Figure 11:
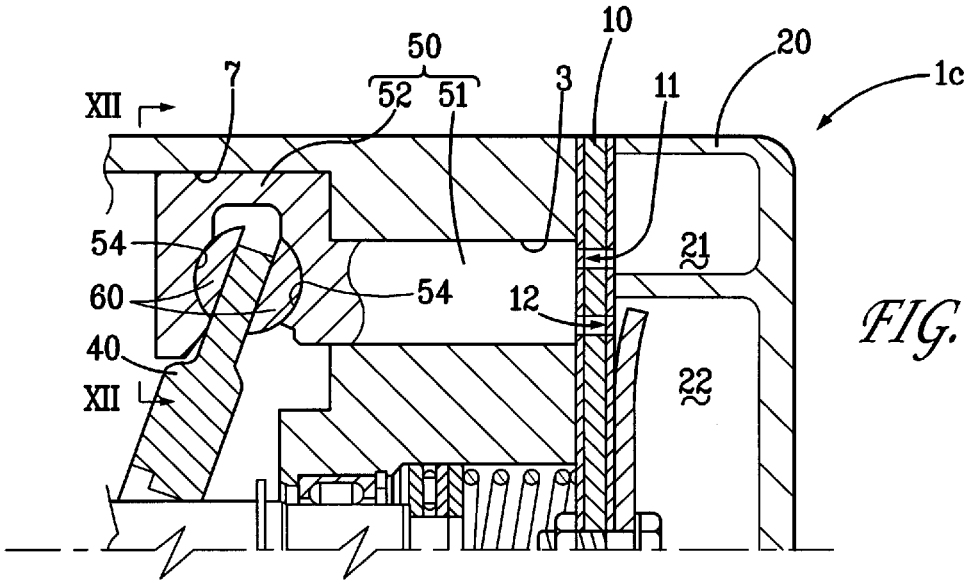
FIG. 11 shows a compressor according to a third representative embodiment.
Figure 12:
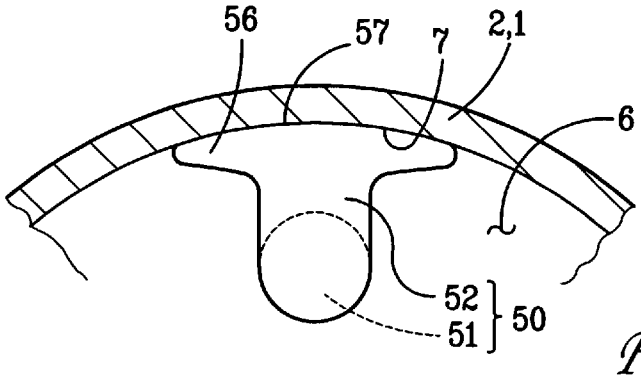
FIG. 12 is a sectional view taken along the line XII—XII in FIG. 11.
Figure 13:
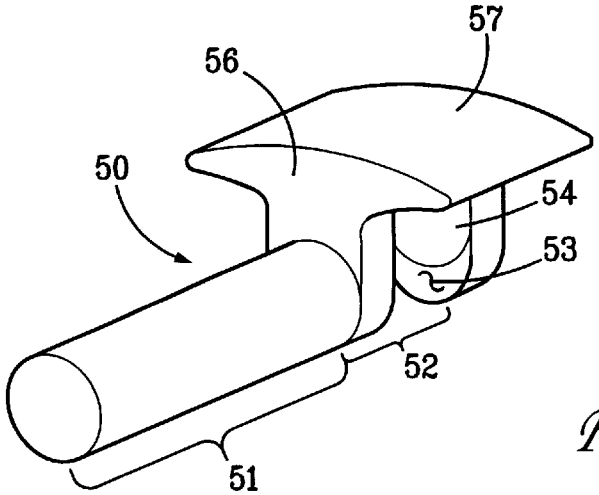
FIG. 13 shows a piston of the compressor according to the third representative embodiment.

A compressor 1*c* according to the third representative embodiment of the invention will be described with reference to FIG. 11 through FIG. 13. In compressor 1*c,* a piston guide 56 may be disposed facing the inner wall surface 7 of the crank chamber 6 on the engaging portion 52 of the piston 50 and have a surface area that is greater than the surface area of the pair of shoe seats 54 and extends over both shoe seats 54 and the piston head 51. The piston guide 56 may have a length extending over both shoe seats 54, so as to extend from one end to the other end of the engaging portion 52.

The extending surface serves as a guide surface 57 to guide the piston guide 56 along the inner wall surface 7 of the crank chamber 6 during the operation of the compressor. That is, the guide surface 57 of the piston guide 56 has an arcuate surface with an axial center that is the same as the axial center of the drive shaft 30. The piston guide 56 preferably faces the inner wall surface 7 of the crank chamber 6 and has substantially the same diameter as the inner wall surface 7 of the crank chamber 6.

Because the construction of the first detailed representative embodiment also generally corresponds to the construction of the third detailed representative embodiment, the same reference numbers are given to the same components, and description will be omitted for components that are common between the two embodiments.

Therefore, in the third representative embodiment, the side force on the piston 50, which is generated by the compression reaction force of the refrigerant during the reciprocating movement of the piston 50, is borne by (1) the mutual facial contacting area between the inner wall surface 7 of the crank chamber 6 and the guide surface 57 of the piston guide 56 and (2) the mutual contacting area between the inner surface of the cylinder bore 3 and the outer surface of the piston head 51. Because the facial pressure of the mutual contacting area between the inner surface of the cylinder bore 3 and the outer surface of the piston head 51 is reduced, wear caused by mutual contacting also is reduced, thereby resulting in improved durability.

Further, when the swash plate 40 rotates, a rotational moment is exerted onto the piston 50 in a direction along which the piston 50 rotates around the axial line thereof by friction between the pair of shoes 60 and the pair of shoe seats 54. At this time, since the guide surface 57 of the piston guide 56 contacts the inner wall surface 7 of the crank chamber 6, the piston 50 can be prevented from turning. In particular, if the guide surface 57 of the piston guide 56 has a length extending over the pair of shoe seats 54 and contacts the inner wall surface 7 of the crank chamber 6, the mutual contacting area between the inner wall surface 7 of the crank chamber 6 and the guide surface 57 of the piston guide 56 can be prevented from wearing, even if a large rotational moment is exerted onto the piston 50.

Japanese Laid-open Patent Publication Nos. 7-180658 and 7-189897, for example, describe a compressor having a piston with a turn-stop portion disposed on the engaging portion of the piston. If carbon dioxide is utilized with such a compressor design, the turn-stop portion of the engaging portion is remarkably worn by the great rotational moment exerted onto the piston, and abnormal noise such as tapping sounds will be generated.

To the contrary, in the third representative embodiment, the mutual contacting area between the inner wall surface 7 of the crank chamber 6 and the guide surface 57 of the piston guide 56 can be prevented from wearing, even if a large rotational moment is exerted onto the piston 50, because the guide surface 57 of the piston guide 56 has a surface extending over the pair of shoe seats 54. The guide surface 57 also may be used as a turn-stop portion. In this case, the fitting length between the piston head 51 and cylinder bore 3 is made longer to bear the side force, and the facial pressure per unit area may be reduced.

What is claimed is:

1. A compressor comprising:

a housing comprising a cylinder bore;

a piston disposed within the cylinder bore, the piston comprising a piston head and an engaging portion having a piston guide fixed to the engaging portion and a pair of shoe seats coupled to a pair of shoes, wherein the piston guide has a length that is greater than the length of the pair of shoe seats with respect to the reciprocating direction of the piston and a width that is greater than the width of the pair of shoe seats with respect to the circumferential direction of the piston, and the piston guide is reciprocally fitted within an inner surface of the housing and the piston guide is adapted to slide with respect to the cylinder bore;

a drive shaft having an axis of rotation; and a swash plate coupled to the drive shaft and to the engaging portion of the piston via the shoes, the swash plate rotating together with the drive shaft, the swash plate having an angle of inclination with respect to a plane perpendicular to the drive shaft axis of rotation, wherein the piston reciprocates in response to the rotation of the swash plate and the piston head in the cylinder bore compresses a refrigerant by the reciprocating movement.

2. A compressor as set forth in claim 1, wherein said piston guide has a curved guide surface that contacts the inner surface of the housing.

3. A compressor as set forth in claim 2, wherein the guide surface has an arcuate shape that contacts the inner surface of the housing.

4. A compressor as set forth in claim 3, wherein an arc of the guide surface has a center axis this is coincident with the rotating axis of the drive shaft.

5. An air conditioning system comprising:

a compressor according to claim 1, the compressor compressing carbon dioxide.

6. A compressor as in claim 1, wherein the piston guide is adapted to prevent the piston head from rotating during operation.

7. A compressor as in claim 6, wherein the piston guide and the piston head have a radius of curvature and the radius of curvature of the piston guide is larger than the radius of curvature of the piston head.

8. A compressor as in claim 7, wherein the piston guide and the piston head each comprise an axial center and the axial center of the piston guide is offset inwardly with respect to the axial center of the piston head.

9. A compressor as in claim 1, wherein the housing further comprises a guide bore that has a diameter larger than the diameter of the cylinder bore and the piston guide is adapted to contact and slide with respect to an inner surface of the guide bore.

10. A compressor as set forth in claim 1, wherein the housing of the compressor includes a cylinder block and the piston guide includes a portion that slides within the cylinder block.

11. A compressor as set forth in claim 1, wherein the piston guide is disposed adjacent to the piston head.

12. A compressor comprising:

a cylinder bore having a guide bore adjacent thereto, the guide bore having a diameter that is larger than the cylinder bore diameter, both the cylinder bore and the guide bore being disposed in a compressor housing;

a piston disposed within the cylinder bore, the piston comprising a piston head and an engaging portion having a fitting guide and a pair of shoe seats coupled to a pair of shoes, the fitting guide having a fitting surface reciprocally fitted to the guide bore, wherein the fitting guide has a length that is greater than the length of the pair of shoe seats with respect to the reciprocating direction of the piston and a width that is greater than the width of the pair of shoe seats with respect to the circumferential direction of the piston;

a drive shaft; and a swash plate coupled to the drive shaft and to the engaging portion of the piston via the shoes, the swash plate rotating together with the drive shaft, the swash plate having an angle of inclination with respect to a plane perpendicular to the axis of rotation, wherein the piston reciprocates in response to the rotation of the swash plate and the piston head in the cylinder bore compresses a refrigerant by the reciprocating movement.

13. A compressor as set forth in claim 12, wherein the fitting surface of said fitting guide section has a cylindrical surface corresponding to the inner surface of the guide bore.

14. A compressor as set forth in claim 12, wherein the fitting surface of said fitting guide has an arcuate surface corresponding to the inner surface of the guide bore.

15. A compressor as set forth in claim 12, wherein a center axis of the fitting guide is offset with respect to an axial center of the piston head.

16. A compressor as set forth in claim 12, wherein the piston guide has a piston turn-stop portion and a side force receiving portion, the piston turn-stop portion protruding outwardly from a surface of said piston head and extending over said pair of shoe seats, the piston turn-stop portion having a surface area that exceeds a surface area of the pair of shoe seats, and the piston turn-stop portion is adapted to reciprocate along the inner surface of the guide bore when the piston reciprocates, wherein the side force receiving portion has a shape that corresponds to the guide bore.

17. An air conditioning system comprising:

a compressor according to claim 12, the compressor compressing carbon dioxide.

18. A compressor as set forth in claim 12, wherein the housing of the compressor includes a cylinder block and the guide bore is formed within the cylinder block and the fitting guide includes a portion that slides within the cylinder block.

19. A compressor as set forth in claim 12, wherein the fitting guide is disposed adjacent to the piston head.

20. A compressor comprising:

a housing comprising cylinder bore and a guide bore adjacent to the cylinder bore, wherein the diameter of the guide bore is larger than the diameter of the cylinder bore;

a piston disposed within the cylinder bore and the guide bore, the piston comprising a piston head and an engaging portion having a fitting guide, wherein the fitting guide has a fitting surface reciprocally fitted within the guide bore, wherein the fitting surface has a length that is greater than the length of the pair of shoe seats with respect to the reciprocating direction of the piston;

a drive shaft; and a swash plate coupled to the drive shaft and to the engaging portion of the piston and adapted to reciprocate the piston head within the cylinder bore when the drive shaft rotates.

21. A compressor as in claim 20, wherein the fitting guide and the piston head each comprise an axial center and the axial centers are offset.

22. A compressor as in claim 21, wherein the axial center of the fitting guide is inward with respect to the axial center of the piston head.

23. A compressor as in claim 20, wherein the fitting guide is adapted to prevent the piston head from rotating during operation.

24. A compressor as in claim 20, wherein the fitting guide and the piston head have radius of curvature and the radius of curvature of the fitting guide is larger than the radius of curvature of the piston head.

25. A compressor as in claim 24, wherein the fitting guide and the piston head each comprise an axial center and the axial center of the fitting guide is offset inwardly with respect to the axial center of the piston head.

* * * * *